US009731869B2

(12) United States Patent
Walsh et al.

(10) Patent No.: US 9,731,869 B2
(45) Date of Patent: Aug. 15, 2017

(54) CONTAINER

(75) Inventors: Philip Walsh, Bristol (GB); Peter Watts, Nottingham (GB)

(73) Assignee: Archimedes Development Limited, Nottingham (GB)

( * ) Notice: Subject to any disclaimer, the term of this patent is extended or adjusted under 35 U.S.C. 154(b) by 0 days.

(21) Appl. No.: 13/983,400

(22) PCT Filed: Jan. 26, 2012

(86) PCT No.: PCT/GB2012/050163

§ 371 (c)(1),
(2), (4) Date: Aug. 2, 2013

(87) PCT Pub. No.: WO2012/104607

PCT Pub. Date: Aug. 9, 2012

(65) Prior Publication Data

US 2013/0313287 A1 Nov. 28, 2013

(30) Foreign Application Priority Data

Feb. 4, 2011 (EP) ..... 11153387

(51) Int. Cl.
*B67B 1/00* (2006.01)
*B65D 39/10* (2006.01)
(Continued)

(52) U.S. Cl.
CPC ..... *B65D 39/10* (2013.01); *B65D 1/0246* (2013.01); *B65D 41/3404* (2013.01); *B65D 50/046* (2013.01); *B65D 55/022* (2013.01)

(58) Field of Classification Search
CPC .. B65D 39/10; B65D 1/0246; B65D 41/3404; B65D 50/406; B65D 55/022
(Continued)

(56) References Cited

U.S. PATENT DOCUMENTS 3,857,508 A 12/1974 Labarge
4,345,691 A * 8/1982 Burke ..... 215/216
(Continued)

FOREIGN PATENT DOCUMENTS

CN 1180337 A 4/1998
DE 1586578 5/1970
(Continued)

OTHER PUBLICATIONS

English Translation of Notice of Rejection from Japanese Patent Office, mailed Aug. 20, 2013 for JP Appl. Ser. No. 2011-530545.
Japanese Official Action, Feb. 23, 2016.

*Primary Examiner* — Lien Ngo
(74) *Attorney, Agent, or Firm* — Chavous Intellectual Propery Law LLC

(57) ABSTRACT

A container (100), comprising a thread (120) arranged around an opening (110) for engaging a corresponding thread (120) of a closure (400), more than four retention members (140) arranged around the opening (110), each retention member (140) having an end-face for abutting a member (510) on an interior surface of the closure (400) to impede unthreading of the closure (400), the retention members (140) being arranged such that a tangent (170) to each end-face of the retention members (140) intersects a plane (160, 350) bisecting the container (100) at an obtuse angle (171), wherein the retention members (140) are arranged in first and second groups, the first group (141, 410) comprising one retention member (140) having an end-face substantially parallel to the plane bisecting the container (100), and the second group (142, 420) comprising two or more retention members (140), the first and second groups being arranged on one side of the plane (160, 350), each in a respective quadrant of the container (100), the teeth of the second group (142, 420) have a first inter-tooth spacing, and a second inter-tooth spacing is provided
(Continued)

between an end-face of the retention member of the first group (141, 410) and a first retention member of the second group (142, 420), and the second inter-tooth spacing is larger than the first inter-tooth spacing.

10 Claims, 6 Drawing Sheets

(51) Int. Cl.

| | |
|---|---|
| ***B65D 1/02*** | (2006.01) |
| ***B65D 41/34*** | (2006.01) |
| ***B65D 50/04*** | (2006.01) |
| ***B65D 55/02*** | (2006.01) |

(58) Field of Classification Search
USPC ..... 222/215, 153.1; 215/263, 252
See application file for complete search history.

(56) References Cited

U.S. PATENT DOCUMENTS

| | | | | |
|---|---|---|---|---|
| 4,366,921 | A | 1/1983 | Kirk, Jr. | |
| 4,565,302 | A | 1/1986 | Pfeiffer et al. | |
| 4,746,035 | A * | 5/1988 | Anderson et al. | 222/153.06 |
| 4,967,539 | A * | 11/1990 | Hansen | 53/453 |
| 5,511,677 | A | 4/1996 | Oder | |
| 6,557,714 | B2 * | 5/2003 | Babcock et al. | 215/252 |
| 2005/0252878 | A1 * | 11/2005 | Babcock | B65D 41/3428 215/252 |
| 2006/0021614 | A1 | 2/2006 | Wermeling | |
| 2006/0111680 | A1 * | 5/2006 | Spada et al. | 604/295 |
| 2006/0207960 | A1 | 9/2006 | Bastero Lopez | |
| 2007/0131641 | A1 * | 6/2007 | Higgins | 215/252 |
| 2008/0314860 | A1 | 12/2008 | Pugne et al. | |
| 2011/0257632 | A1 | 10/2011 | Castile | |
| 2012/0024724 | A1 | 2/2012 | Beardsall | |
| 2012/0055929 | A1 | 3/2012 | Hayton | |

FOREIGN PATENT DOCUMENTS

| | | |
|---|---|---|
| JP | S59199468 | 11/1984 |
| JP | H03505213 | 4/1991 |
| JP | H05228213 | 9/1993 |
| JP | 2000511499 | 9/2000 |
| JP | 2001-97414 | 4/2001 |
| JP | 2001518097 | 10/2001 |
| JP | 2004505052 | 2/2004 |
| JP | 2004505730 | 2/2004 |
| JP | 2006516272 | 6/2006 |
| JP | 2007-514612 | 6/2007 |
| JP | 2007525528 | 9/2007 |
| JP | 2008044951 | 2/2008 |
| JP | 2008114102 | 5/2008 |
| WO | 9003796 | 4/1990 |
| WO | 9625966 | 8/1996 |
| WO | 9748615 | 12/1997 |
| WO | 9962770 | 12/1999 |
| WO | 0213886 A2 | 2/2002 |
| WO | 2004062561 | 7/2004 |
| WO | 2007065240 | 6/2007 |

* cited by examiner

CONTAINER

This is an application that entered the national stage pursuant to 35 U.S.C. 371 from International Appl. Ser. No. PCT/GB2012/050163, which was filed on Jan. 26, 2012 and claims the benefit of foreign priority to European Patent Appl. Ser. No. 11153387.3, which was filed on Feb. 4, 2011, both applications hereby incorporated by reference in their entireties.

Embodiments of the present invention relate to a container having a retainer for securely retaining a closure on the container. In particular, although not exclusively, embodiments of the present invention relate to a bottle, such as a bottle for storing pharmaceutical solutions, having a retainer for securely retaining a closure, such as a spray pump, on the bottle.

BACKGROUND

Medicaments, such as those provided in solution form, are often stored in a container, such as a bottle, having a closure configured to dispense a predetermined dose of the medicament. The closure may be a spray pump arranged to be actuated by a user to deliver the predetermined dose of the medicament in spray form. The dose may be determined by the design of the closure or may be selected by a user from amongst a range of doses permitted by the closure. In either case, the closure is intended to prevent unmetered dispensing of the medicament. However, removal of the closure from the container allows uncontrolled access to the medicament held within the container and is problematic.

It is an object of embodiments of the invention to at least mitigate one or more of the problems of the prior art.

SUMMARY OF THE INVENTION

According to an aspect of the invention, there is provided a container comprising a thread arranged around an opening of the container for engaging a corresponding thread of a closure, more than four retention members arranged around the opening, each retention member having an end-face for abutting a member on an interior surface of the closure to impede unthreading of the closure, wherein the retention members are arranged such that a tangent to each end-face of the retention members intersects a plane bisecting the container at an obtuse angle.

According to an aspect of the invention, there is provided a container comprising a thread arranged around an opening of the container for engaging a corresponding thread of a closure, more than four retention members arranged around the opening, each retention member having an end-face for abutting a member on an interior surface of the closure to impede unthreading of the closure, wherein the retention members are arranged such that a tangent to each end-face of the retention members intersects a plane bisecting the container at an obtuse angle, the retention members are arranged in first and second groups, the first group comprising one retention member having an end-face substantially parallel to the plane bisecting the container, and the second group comprising two or more retention members, the first and second groups being arranged on one side of the plane, each in a respective quadrant of the container, wherein the teeth of the second group have a first inter-tooth spacing, and a second inter-tooth spacing is provided between an end-face of the retention member of the first group and a first retention member of the second group, and the second inter-tooth spacing is larger than the first inter-tooth spacing.

Embodiments of the invention may be bisected by the plane with which the tangent to each abutment member's end-face forms an obtuse angle. Some embodiments of the invention may be envisaged which are also bisectable by one or more planes with which the tangents may form an acute angle. However, embodiments of the invention are characterised by being bisectable by one or more planes with which the tangents only form obtuse angles.

The plane bisecting the container may be a mould splitting plane.

Optionally the obtuse angle includes retention member having a tangent which intersects the plane at substantially 0° or 90°. The retention members (140) may be arranged to have a spacing between retention members (140) which varies around the opening (110).

The retention members (140) may be arranged to have a spacing selected from between two or more different spacings.

The retention members may be teeth having a portion extending gradually outward from the container to the end-face.

The retention members may be arranged around the opening to have only a single plane of rotational symmetry.

The retention members may be arranged around the opening to form two teeth-free regions around the opening of generally between 35° and 80°.

The retention members may be arranged in first and second groups, the first group comprising one retention member having an end-face substantially parallel to the plane bisecting the container, and the second group comprising two or more retention members, the first and second groups being arranged on one side of the plane, each in a respective quadrants of the container.

The container may be a bottle for storing a pharmaceutical.

The container may comprise two first groups of retention members and two second groups of retention members.

The container may comprise six or more retention members.

According to another aspect of the invention there is provided an assembly comprising a container according to an aspect of the invention engaged with a closure having a plurality of members on an interior surface thereof arranged to abut the end-faces of at least some of the retention members.

According to a still further aspect of the invention there is provided a method of manufacturing a container, comprising bringing together a plurality of mould portions to form a mould for the container there-between, the container having more than four retention members arranged around an opening of the container, each retention member having an end-face, wherein the retention members are arranged such that a tangent to each end-face intersects a plane bisecting the container at an obtuse angle, injecting a fluid into mould; and moving apart the mould portions to release the container from there-between.

According to a yet further aspect of the invention, there is provided a method of manufacturing a container, comprising bringing together a plurality of mould portions to form a mould for a container there-between, the container having more than four retention members arranged around the opening, each retention member having an end-face for abutting a member on an interior surface of the closure to impede unthreading of the closure, the retention members being arranged such that a tangent to each end-face of the retention members intersects a plane bisecting the container at an obtuse angle, wherein the retention members are arranged in first and second groups, the first group comprising one retention member having an end-face substantially parallel to the plane bisecting the container, and the second group comprising two or more retention members, the first and second groups being arranged on one side of the plane, each in a respective quadrant of the container, the teeth of the second group have a first inter-tooth spacing, and a second inter-tooth spacing is provided between an end-face of the retention member of the first group and a first retention member of the second group, and the second inter-tooth spacing is larger than the first inter-tooth spacing; injecting a fluid into mould; and moving apart the mould portions to release the container from there-between

BRIEF DESCRIPTION OF THE DRAWINGS

Embodiments of the invention will now be described by way of example only, with reference to the accompanying figures, in which.

DETAILED DESCRIPTION OF EMBODIMENTS OF THE INVENTION

Figure 1:
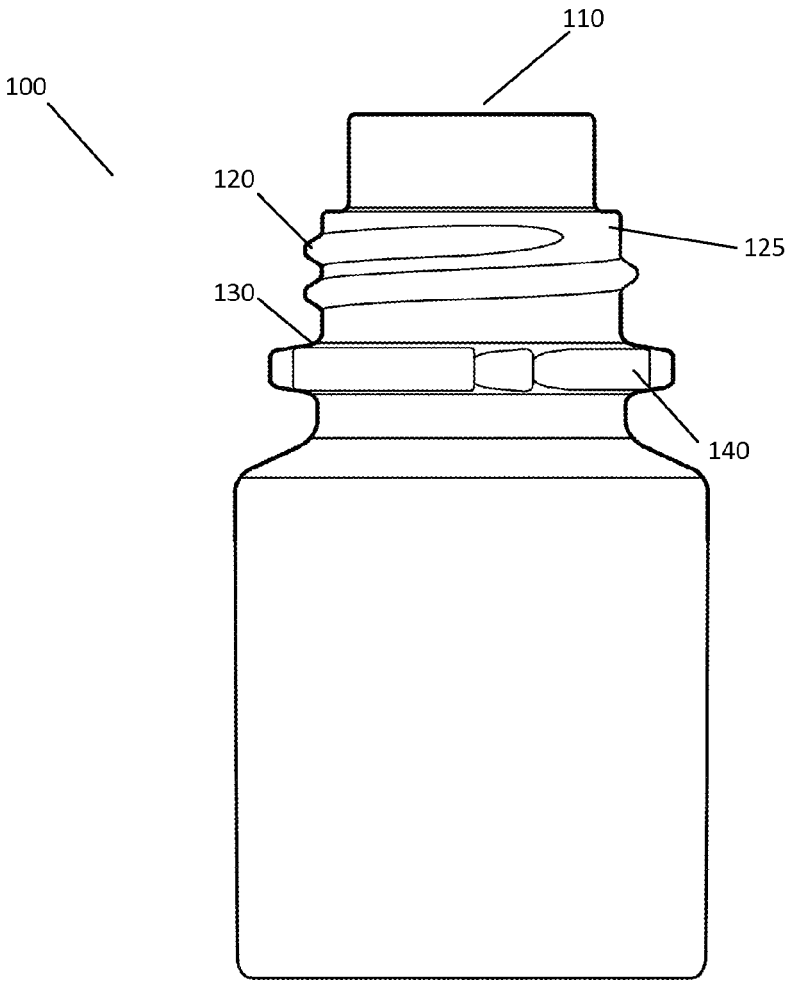
FIG. 1 shows a side view of a container according to an embodiment of the invention.
Figure 2:
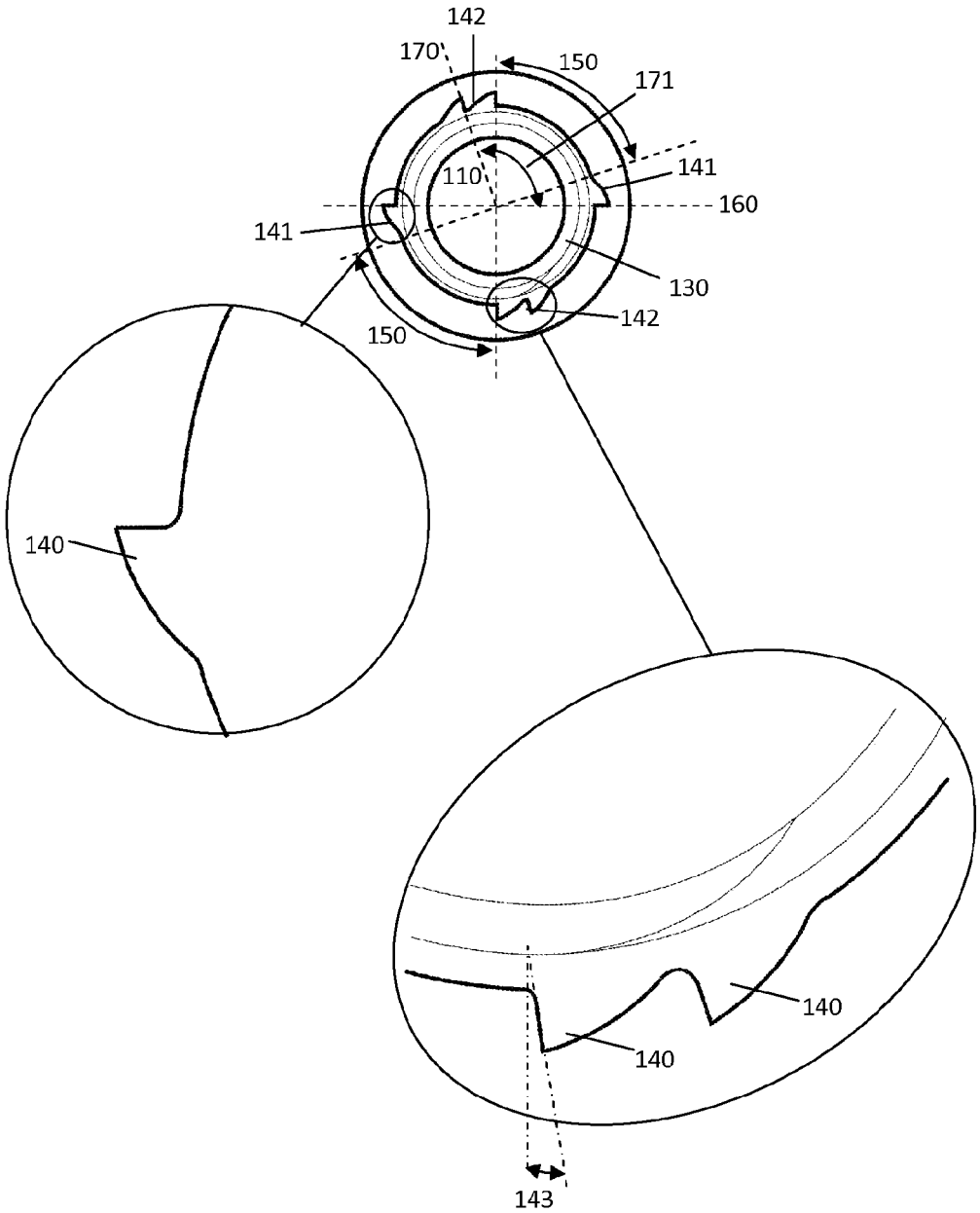
FIG. 2 shows a horizontal cross section through a neck of the container according to an embodiment of the invention.
Figure 3:
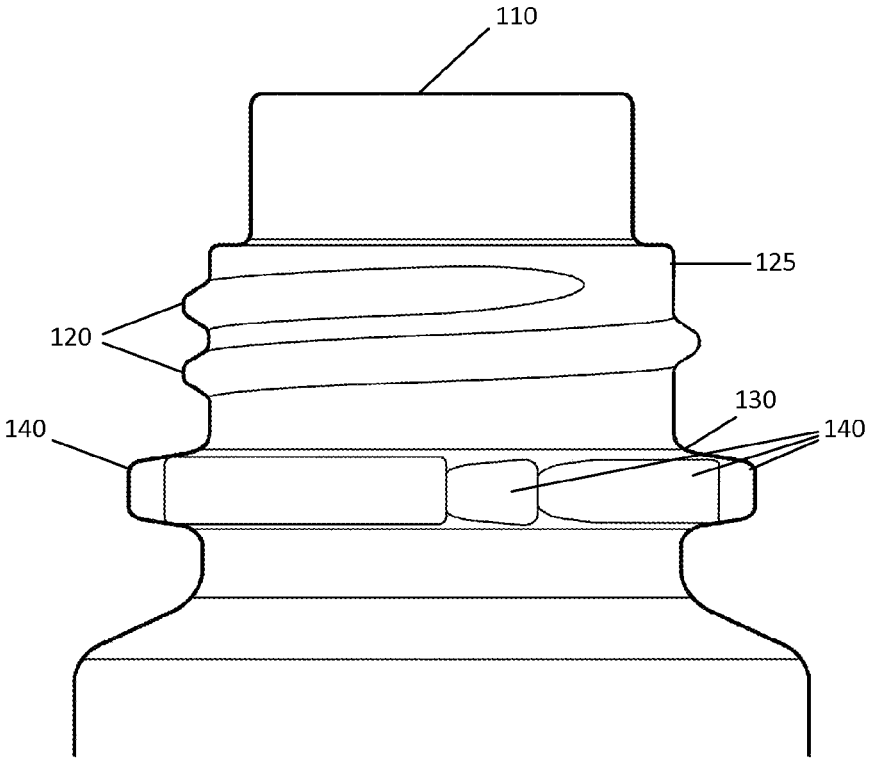
FIG. 3 shows an enlarged view of the neck of the container according to an embodiment of the invention.

Referring to FIGS. 1-3, a container 100 according to an embodiment of the invention is shown. The container 100 may be used for storing a medicament and embodiments of the invention will be explained with reference to storage and dispensing of the medicament, although it will be realised that other substances may be stored in the container 100.

The container 100 shown in FIG. 1 is a bottle 100, although it will be appreciated that embodiments of the invention may be envisaged as other forms of container. FIG. 1 shows a full-height view of the bottle 100 whilst FIG. 3 shows an enlarged view of an upper portion of the bottle 100. The bottle 100 has an opening 110 surrounded by a screw thread 120 formed on a neck 125 of the bottle 100 onto which a closure (not shown in FIGS. 1 to 3) having a corresponding thread may be engaged. The closure may be any closure which is suitable to contain the medicament within the bottle 100. In some embodiments, the closure comprises a dosage mechanism for delivering a predetermined dose of the medicament. The closure may be a spray pump which, when actuated by a user, delivers a dose of the medicament in spray form.

Following production of the bottle, which is explained below, the bottle 100 is filled with a quantity of the medicament. The closure is then threaded onto the neck 125 of the bottle 100 to close the opening 110 of the bottle 100 and to retain the medicament therein. Embodiments of the invention aim to improve the retention of the closure on the bottle 100. In particular, some embodiments of the invention aim to make it more difficult to accidentally or intentionally remove the closure from the bottle 100, thereby accessing the medicament in an uncontrolled or unmetered manner.

Embodiments of the invention comprise a retention ring 130 arranged around the neck 125 of the bottle 100. The retention ring 130 is provided for preventing, or at least improving, retention of the closure on the bottle 100. In particular, the retention ring 130 is configured to increase an unscrewing torque required to remove the closure from the bottle 100.

The retention ring 130 comprises more than four retention teeth 140 (not all of which are indicated with reference numerals for clarity) arranged there-around. The embodiment shown in FIGS. 1-3 comprises six retention teeth. A further embodiment shown in FIG. 5 comprises ten retention teeth 140. It will be realised that embodiments of the invention may be envisaged having other numbers of retention teeth greater than four. Some embodiments of the container comprise six or more retention teeth. The retention teeth 140 are provided for engaging with features arranged on an interior surface of the closure. The features of the closure may, in some embodiments, also be teeth, although any feature arranged on the closure for engaging the retention teeth 140 is envisaged.

In embodiments of the invention, the retention teeth 140 are arranged such that a tangent 170 to an end-face of each retention tooth 140 intersects a plane 160 bisecting the bottle 100 at an obtuse angle 171. The tangent 170 to one of the teeth 140 is illustrated in FIG. 2. The plane 160 vertically bisects the bottle through a centre of the bottle 100. The plane 160 bisects the bottle into substantially equal sized portions. It will be understood herein that the term "obtuse angle" includes those retention teeth 140 whose tangent intersects the plane 160 at substantially 0° i.e. is generally parallel to the plane 160, and those teeth 140 whose tangent intersects the plane at substantially 90° i.e. is generally at a right angle to the plane 160, as will be explained. In other words, the tangent to each end-face of the retention teeth 140 does not intersect the plane 160 at an angle of between 1° and 89° or in some embodiments between 85° and 5°. The angle is measured in a tightening direction i.e. extending forward from the end-face of the retention tooth 140 to the plane 160.

Referring particularly to FIG. 2, in embodiments of the invention, the retention teeth 140 are arranged in an unevenly-spaced pattern around the neck of the bottle 100. That is, a spacing between consecutive teeth 140 is not equal between every tooth. In particular, opposing regions 150 of the retention ring 130 are devoid of retention teeth 140.

Usually, although not exclusively, the thread around the neck 125 of the bottle 100 is a right-hand or clockwise thread. The retention teeth 140 are arranged about the neck 125 of the bottle to face the same direction as the thread. That is, as the closure is screwed onto the bottle, usually in the right-hand or clockwise direction of rotation, the features on the closure gradually engage, firstly, with the outwardly extending body of each retention tooth 140 until passing over the abruptly terminating generally flat end-face of the tooth 140. However, when a force is applied to the closure in an opposing direction, usually a left-hand or counter-clockwise direction, the features on the closure abut against the generally flat end-face of the retention teeth 140 to resist unscrewing of the closure from the bottle 100.

Figure 5:
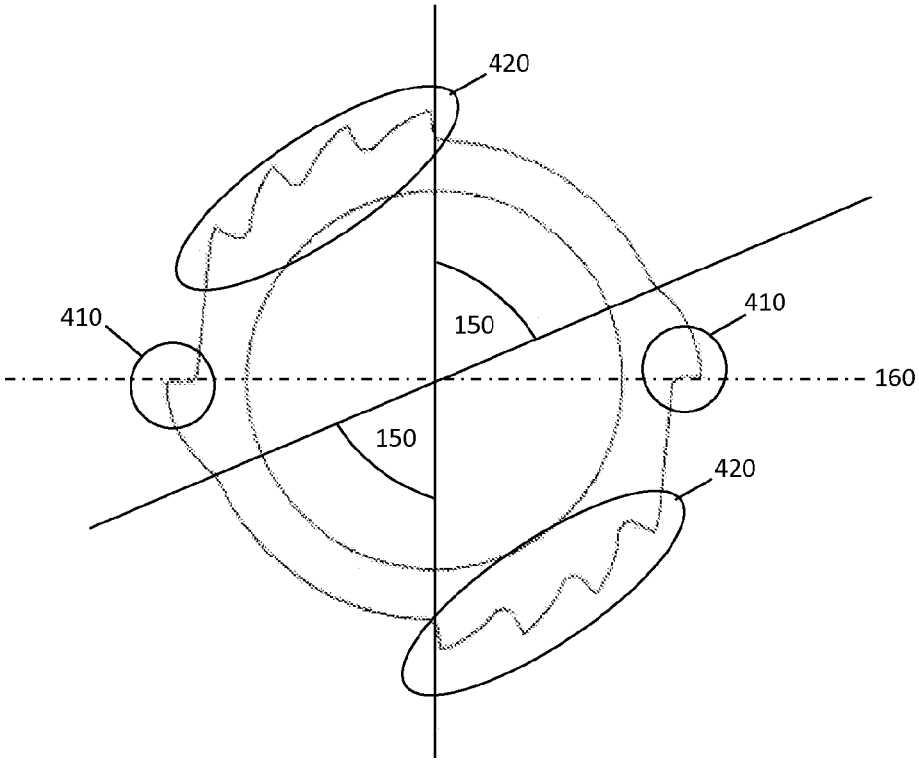
FIG. 5 is an illustration of a retention ring according to another embodiment of the invention.

In embodiments of the invention, as best shown in FIGS. 2 and 5, the retention teeth 140 are arranged in groups around the circumference of the neck 125, wherein the groups may comprise differing numbers of teeth. In the embodiment shown in FIGS. 1-3 and 5, the teeth 140 form a plurality of groups containing differing numbers of teeth. In the embodiments shown in FIGS. 1-3 and 5, the teeth 140 form two groups. A first group 141, 410 includes a single tooth whilst a second group 142, 420 includes two or more teeth. The groups 141, 410, 142, 420 are demarcated by a large-inter-tooth spacing between the groups being larger than that between adjacent teeth, such as those forming the second group 142, 420. In other words, the teeth 140 are arranged to have an inter-tooth spacing which varies around the retention ring 130. The bottle 100 includes two first groups 141, 410 of teeth, each comprising a single tooth, at opposed sides of the bottle 100, and two second groups 142, 420 of teeth, each comprising two or four teeth, respectively, at opposed sides of the bottle 100. However it will be realised that the second groups of teeth 142, 420 may comprise other numbers of teeth and do not need to comprise equal numbers of teeth 140. Similarly, it will be realised that embodiments may be envisaged only having the second groups 142, 140 of teeth ie no teeth in the first groups 141, 140.

A first, relatively small inter-tooth spacing exists between the generally adjacent teeth of the second group 142, 420 whereas a second, relatively larger spacing exists between the tooth of the first group 141, 410 and an end tooth of the second group 142, 420 (either tooth can be considered as an end tooth in the second group 142 of FIGS. 1-3 comprising two teeth). However in some embodiments the spacing between the tooth of the first group 141, 410 and the end tooth of the second group is considered forward of the first tooth from the end-face of the tooth of the first group to the outwardly extending portion of the end tooth of the second group 142, 420. Thus the inter-tooth spacing of teeth 140 around the retention ring 130 varies. In particular, in some embodiments, the inter-tooth spacing is selected from amongst two different distances. In the embodiment shown in FIGS. 1-3, the inter-tooth spacing alternates. The inter-tooth spacing, or the space existing between the first and second groups of teeth 141, 410, 142, 420 provides opposed regions 150 around the retention ring 130 which do not include teeth 140. The teeth 140 are arranged around the retention ring to form two teeth-free regions 150, each may generally be of between 35° and 80° in angle. Advantageously, the regions 150 not having teeth allow easier manufacture of embodiments of the invention, as will be explained. Furthermore, in some embodiments, the inter-tooth spacing of the teeth of the second group being substantially around one tooth length causes an entrapment of closure projections which engage with the teeth between teeth of the second group 142 when the closure is forcibly unscrewed.

In some embodiments, each tooth 140 is generally identical other than for the variance in inter-tooth spacing. However, in other embodiments, the teeth 140 forming each group 141, 410, 142, 420 may be different. Each tooth 140 may have the same length, (length may include the inter-tooth spacing i.e. the term length may indicate the angle between adjacent teeth) which may, in some embodiments, be an angular portion of around 20° of the bottle 100, such as 18°, although this is merely exemplary. The tooth 140 forming the first group 141, 420 may have an abrupt end face which is substantially parallel to a plane 160 intersecting the centre of the bottle 100 when viewed in horizontal cross section, as shown in FIGS. 2 and 5, whereas the teeth of the second group 142, 420 may include an angular offset from a vertical plane which intersects a base of the end-face, such as an offset causing the end-face of each tooth to decline 143 (or to be laid back from the plane) by around 7°, although other declinations are also envisaged. In particular, this avoids the tangent of the end-face to the tooth intersecting the plane 160 bisecting the container at an acute angle. As will be explained, this improves the manufacturability of the bottle 100.

It will also be appreciated from FIGS. 1-3 and 5 the retention ring 130 according to embodiments of the invention has only a single plane of rotational symmetry. Only a single plane through the centre of the retention ring 130 exists about which the retention ring 130 may be symmetrically rotated. The retention ring 130 may be symmetrically rotated by 180°. In contrast, in prior art arrangements, a plurality of planes may exist around which rotational symmetry is present.

As discussed above, in embodiments of the invention, a plane 160 exists which bisects a centre of container 100. The tangent to the end-face of each retention tooth 140 then intersects the plane 160 at an obtuse angle (0° and 90° inclusive) i.e. without having an acute angle which hinders the manufacture of the bottle 100. If a bottle is manufactured having teeth 140 whose tangent always forms an acute angle, i.e. between 1° and 89°, to a plane bisecting the bottle 100 then damage to some of the teeth 140 is likely to occur during a manufacturing process of the bottle 100.

Figure 4:
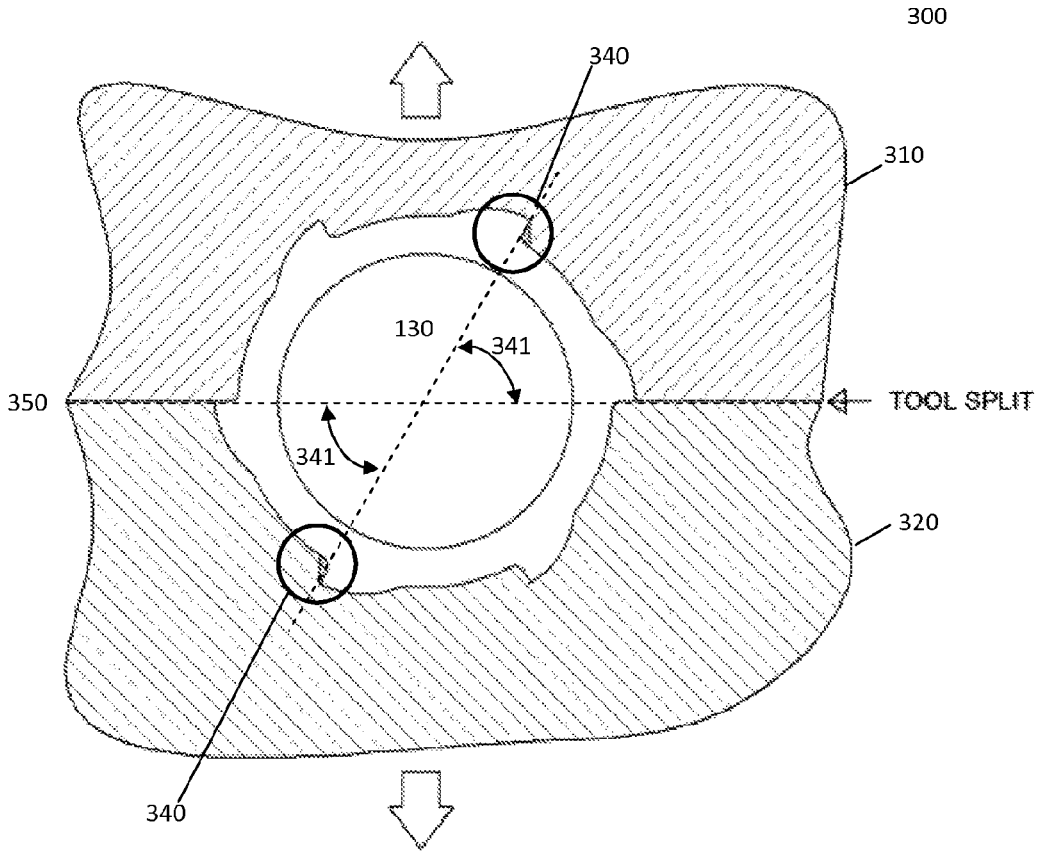
FIG. 4 shows a horizontal cross section through a neck of a container within a manufacturing mould.

Bottles 100 are frequently made in a mould or tool, denoted generally as 300 in FIG. 4, formed by first 310 and second 320 halves which are bought together to form the bottle 100 to be manufactured there-between. It will be realised that the number of mould portions is not limiting. Material in a liquid state, such as plastic or glass, is then inserted into a cavity formed between the mould halves 310, 320 which solidifies to form the bottle 100. The mould halves 310, 320 are then moved apart in the direction of the arrows shown in FIG. 3, such that the bottle 100 is released from between the mould halves 310, 320.

However, as shown in FIG. 4, teeth 340 forming an acute angle 341 with a mould or tool splitting plane 350 may be damaged by the moving apart of the mould portions. As can be appreciated from FIG. 4, the teeth 340 having an end-face which forms an angle 341 of less than 90°, in particular between 89° and 1°, to a plane 350 along which the mould 300 splits, denoted with "tool split" in FIG. 4, may be broken by an opening force exerted on the mould 300 to remove the bottle 100.

Advantageously, the arrangement of teeth shown in FIGS. 1-3 and 5 avoids the location of teeth 140 in such areas of the retention ring 130 that would cause a breakage of teeth upon splitting of the mould 300. That is, embodiments of the invention do not include teeth having an abrupt end which forms an angle of less than 90° to a mould or tool splitting plane. It will be noted that the teeth 140 in the first group 141, 410 have an abrupt end which is parallel to the mould splitting plane. In other words, the abrupt end of those teeth lies along the mould splitting plane 350. However, the teeth of the second group 142, 420 are located in areas of the retention ring 130 which do not create an angular intersection between the abrupt end of each tooth and the mould splitting plane being less than 90°. Furthermore, the teeth of the second group 142, 420 may, although not always, also include an additional declination, such as of around 7°, to cause the tooth-end and mould splitting angular intersection to be substantially greater than 90°, thereby further aiding removal of the bottle 100 from the mould 300.

FIG. 5 illustrates a horizontal cross section through the retention ring 130 as shown in FIGS. 1 and 2 which comprises four teeth 140 in the second group 142. Whilst an explanation of the present invention has been provided with reference to FIGS. 1-3 which show an embodiment comprising a retention ring 130 having a second group 142 comprising two teeth 140, it will be realised that the present invention is not so restricted. Embodiments may be provided which include other numbers of teeth in the second group 142. FIG. 5 shows an embodiment of the invention which includes two opposed first groups 410 comprising one tooth having an abrupt tooth-end lying along a mould splitting plane 160 and two opposed second groups 420 comprising four teeth. Other numbers of teeth in the second group 420 are also envisaged. Furthermore, each of the second groups may comprise different numbers of teeth. It can be appreciated that the embodiment shown in FIG. 5 comprises two opposed teeth free-regions 150, as in the embodiment shown in FIGS. 1-3. In some embodiments, the teeth free regions 150 have an angular extent of approximately 70°, although this is merely exemplary and other extents may be envisaged.

Figure 6:
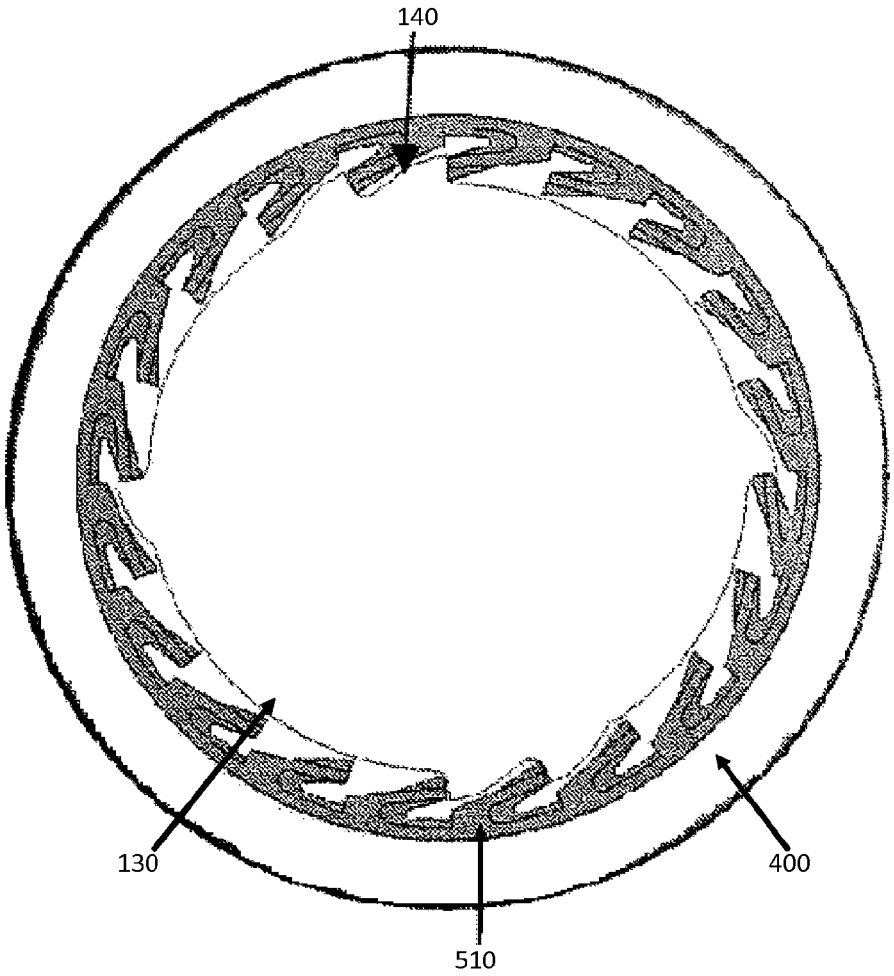
FIG. 6 is an illustration of a closure according to an embodiment of the invention.

FIG. 6 illustrates a cross section through a closure 400 for use with embodiments of the invention. The term closure is understood to mean any device which closes the opening 110 of the bottle 100 by engagement with the thread 120. The closure may be a cap. However, in other embodiments the closure 400 includes a means for dispensing the contents of the bottle in doses of a controlled volume. The closure may include a spray pump mechanism arranged to draw liquid from an interior of the bottle 100 and to emit, in response to actuation by a user, a spray of liquid droplets.

The closure 400 includes a thread (not shown) which is adapted to cooperate with the thread 120 of the bottle 100 such that the closure becomes securely engaged with the bottle 100 in response to rotation of the closure 400 or bottle 100, as will be understood by the skilled person. An interior surface of the closure 400 includes a plurality of projections 510 which are arranged to engage with the teeth 140 of the retention ring 130 to impede subsequent removal of the closure 400 from the bottle 100. The projections 510 shown in FIG. 6 are flexible. However it will be realised that embodiments of the present invention may be used with projections 510 which are substantially rigid i.e. are not flexible.

The projections 510 shown in FIG. 6 are a plurality of fingers which inwardly extend from the interior surface of the closure 400. The fingers 510 are arranged within the closure 400 below the thread (not shown) which engages with the thread 120 of the bottle 100. The fingers 510 extend at an angle into the interior of the closure 400. The fingers may inwardly extend at an angle of, for example, between 10° and 80° from an interior surface of the closure, although other angular projections are envisaged. In some embodiments, an angle of intersection of the fingers 510 and the interior surface of the closure 400 may be substantially equal to an angle at which the teeth 140 outwardly project from the retention ring 130. However, any angle of projection of the fingers 510 may be envisaged which allows the fingers 510 to pass over the teeth 140 when the closure 510 is rotated in a tightening, normally clockwise, direction and causes the fingers 510 to abut the substantially vertical end-face of the teeth 140 when rotated in an opening, normally anti-clockwise, direction. In particular, due to the resilient flexibility of the fingers 510, when the closure 400 or bottle 100 is being rotated to cause a tightening of the closure 400 onto the bottle 100, the fingers 510 engage the teeth 140 and are bent inward by the outwardly extending surface of each tooth 140. Once the fingers 510 pass the abrupt end-face of the teeth 140, they return to their normal position such that the end of the finger 510 is generally adjacent the substantially vertical surface at the end of the tooth (substantially vertical includes any layback of the tooth as discussed above) or end-face. In this way, closing rotation of the closure 400 and/or bottle 100 is easily permitted. However, when the closure 400 or bottle 100 is rotated in an opposed opening direction, the abutment of the fingers 510 against the end-face of the teeth 140 impedes or hinders further rotation. Should an unscrewing rotational force applied to the closure 400 exceed a longitudinal rigidity of the fingers 510, the fingers 510 may, in some embodiments, be caused to buckle or collapse. The collapsed fingers 510 may further impede rotation of the closure 400 with respect to the bottle 100 by becoming trapped between the interior surface of the closure 400 and the teeth 140. In this way, easy removal of the closure 400 from the bottle 100 is prevented.

An experiment was conducted to compare the torque (Newton meters, Nm) required to unscrew a closure 400 in the form of a nasal spray pump from glass bottles 100 having two neck designs. The neck design on one bottle comprised a screw thread below which were four evenly spaced glass lugs or teeth, spaced at approximately 90° to each other. The other bottle was an embodiment of the invention wherein the neck design was a screw thread below which were six glass teeth 140, comprising two oppositely-positioned pairs and two oppositely-positioned single teeth, i.e. comprising a retention ring 130 as shown in FIG. 2.

To each of six bottles of each type was attached the closure 400 in the form of a nasal spray pump which had a screw thread to match that of the bottle 100. Positioned below the screw thread of the closure 400 was a ring of flexible plastic teeth or fingers 510 which occupied the entire inner circumference of the pump and which were designed to engage with the glass teeth 140 on the bottles. To attach the pump to the bottle, the bottle was positioned within a torque meter (Mecmesin, Slinfold, UK) and screwed on by hand until a torque value of 1.2 Nm was displayed. With the assembled pump and bottle remaining within the torque meter, the force required to unscrew the pump from the bottle was measured; a lever was attached to the pump and slowly turned in an anti-clockwise direction until the pump started to move relative to the bottle and there was no further increase in the instrument torque reading.

Mean unscrewing torque values of 3.3 Nm and 4.6 Nm were measured for the four-lug and six-lug bottle designs, respectively. These values represented a 39% increase in unscrewing torque by use the embodiment of the invention shown in FIG. 2, a difference which was statistically significant ($p<0.01$).

Advantageously, embodiments of the invention which comprise six teeth as shown in FIG. 2, or ten teeth i.e. the second group comprises between two and four, or between two and six substantially contiguous teeth increases the required unscrewing torque significantly. Moreover an excessive increase in torque required to screw the closure onto the container, which may be problematic for a manufacturing process, is not required.

It will be appreciated that embodiments of the invention provide a container and method of making a container, such as a bottle, which is engageable with a closure, such as a cap or spray pump by means of a screw thread. Engagement of the container with the closure causes members of the closure to engage with retention members of the container. However, removal of the closure is impeded by the interaction of the closure and retention members. Furthermore, manufacturing of the container is improved by an arrangement of the retention members about the container.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A container, comprising:

a thread arranged around an opening of the container for engaging a corresponding thread of a closure;

more than four retention members arranged around the opening, each retention member having a flat surface, wherein the flat surface abuts a member on an interior surface of the closure to impede unthreading of the closure;

wherein the retention members are arranged into two first retention members and two groups of retention members, the two first retention members being arranged at opposite sides of the container and wherein the flat surface of the two first retention members are aligned to define a first plane bisecting the container and wherein a first one of the first retention members and a first one of the two groups are arranged on one side of the first plane and a second one of the first retention members and a second one of the two groups are arranged on the other side of the first plane, and wherein a second one of the two first retention members and a second one of the two groups are arranged on the other side of the first plane, wherein further each of the first retention members are in separate respective quadrants of the container from one another, wherein the quadrants are defined by the first plane bisecting the container and a second plane that is perpendicular to the first plane bisecting the container and intersects with the first plane bisecting the container and wherein the second plane is aligned to the first flat surfaces of each of the two groups of the retention members; and wherein teeth of each of the two groups have a first inter-tooth spacing of substantially one tooth-length, and wherein a second inter-tooth spacing exists between the flat surface of one of the first retention members and a retention member of one of the two groups of retention members closest to the first one of the first retention members and wherein the second inter-tooth spacing is larger than the first inter-tooth spacing.

2. The container as claimed in claim 1, wherein the teeth of each of the two groups are substantially contiguous.

3. The container of claim 1, wherein the two groups comprise between two and six teeth.

4. The container of claim 1, wherein the first retention members are arranged around the opening to have only a single plane of rotational symmetry.

5. The container of claim 1, wherein the first retention members are arranged around the opening to form two teeth-free regions around the opening of generally between 35° and 800.

6. The container of claim 1, wherein the container is a bottle for storing a pharmaceutical.

7. An assembly, comprising a container according to claim 1, engaged with a closure having a plurality of members on an interior surface thereof arranged to abut the flat surfaces of at least some of the first retention members.

8. The assembly of claim 7, wherein the plurality of members are resiliently flexible.

9. The assembly of claim 7, wherein the plurality of members are fingers inwardly extending at an angle of between 10 and 80° from an interior surface of the closure.

10. A method of manufacturing a container, comprising:

a) forming a container a plurality of mould portions, the container having more than four retention members arranged around the opening, each retention member having a flat surface, wherein the flat surface abuts a member on an interior surface of the closure to impede unthreading of the closure, wherein the retention members are arranged into two first retention members and two groups of retention members, the two first retention members being arranged at opposite sides of the container and wherein the flat surface of the two first retention members are aligned to define a first plane bisecting the container and wherein a first one of the first retention members and a first one of the groups are arranged on one side of the first plane and a second one of the two first retention members and a second one of the two groups are arranged on the other side of the first plane, wherein further each of the first retention members and each of the one of the two groups are in separate respective quadrants of the container from one another, wherein the quadrants are defined by the first plane bisecting the container and a second plane that is perpendicular to the first plane bisecting the container and intersects with the first plane bisecting the container, and wherein teeth of each of the two groups have a first inter-tooth spacing of substantially one tooth length, and wherein a second inter-tooth spacing exists between a flat surface of one of the first one of the first retention members and a retention member of one of the two groups of retention members closest to the one of the first retention members and wherein the second inter-tooth spacing is larger than the first inter-tooth spacing;

(b) injecting a fluid into the mould; and (c) moving apart the mould portions to release the container from there-between.

* * * * *